US005129153A

United States Patent [19]

Burns, Sr.

[11] Patent Number: 5,129,153

[45] Date of Patent: Jul. 14, 1992

[54] STRUCTURAL MEMBER SPACING TOOL

[76] Inventor: Joseph F. Burns, Sr., P.O. Box 324 Fillauer Lake, Cleveland, Tenn. 37364

[21] Appl. No.: 650,885

[22] Filed: Feb. 5, 1991

[51] Int. Cl.[5] ..... G01B 3/30

[52] U.S. Cl. ..... 33/613; 33/562; 33/501.45

[58] Field of Search ..... 33/613, 562, 501.45, 33/501.06, 567, 483; 260/40, 41, 904, 914

[56] References Cited

U.S. PATENT DOCUMENTS

| | | | |
|---|---|---|---|
| 1,066,694 | 7/1913 | Ash et al. . | |
| 2,567,586 | 9/1951 | Werder . | |
| 2,575,595 | 11/1951 | Rienecker . | |
| 2,744,334 | 5/1956 | Jondole . | |
| 2,822,841 | 2/1958 | Huffman . | |
| 2,969,819 | 1/1961 | Bravo . | |
| 3,126,928 | 3/1964 | McMillan | 52/127.2 X |
| 3,201,874 | 9/1965 | Christy . | |
| 3,959,945 | 6/1976 | Allen | 52/127.2 X |
| 4,499,666 | 2/1985 | Smith . | |
| 4,607,438 | 9/1986 | DeFrange . | |
| 4,625,415 | 12/1986 | Diamontis . | |
| 4,843,726 | 7/1989 | Ward . | |
| 4,850,114 | 7/1989 | Vockins | 33/526 |
| 4,953,341 | 9/1990 | Joos | 52/127.2 X |
| 4,958,814 | 9/1990 | Johnson | 33/613 X |

*Primary Examiner*—Harry N. Haroian
*Attorney, Agent, or Firm*—Mason, Kolehmainen, Rathburn & Wyss

[57] ABSTRACT

A structural member spacing tool is adapted to be disposed between adjacent structural members for positioning the structural members a predetermined distance apart. The tool acts as a support to prevent movement of the structural members while they are fastened in place. The tool is provided with parallel, spaced apart support surfaces which provide rigid support within a stud cavity between adjacent stud members. This allows the tool to prevent movement of the studs while they are fastened in place. Since the tool is disposed within the stud cavity, it can be utilized in any stud cavity including the cavity adjacent a corner. The tool can also be used for walls adapted to be constructed flush against a masonry wall.

18 Claims, 2 Drawing Sheets

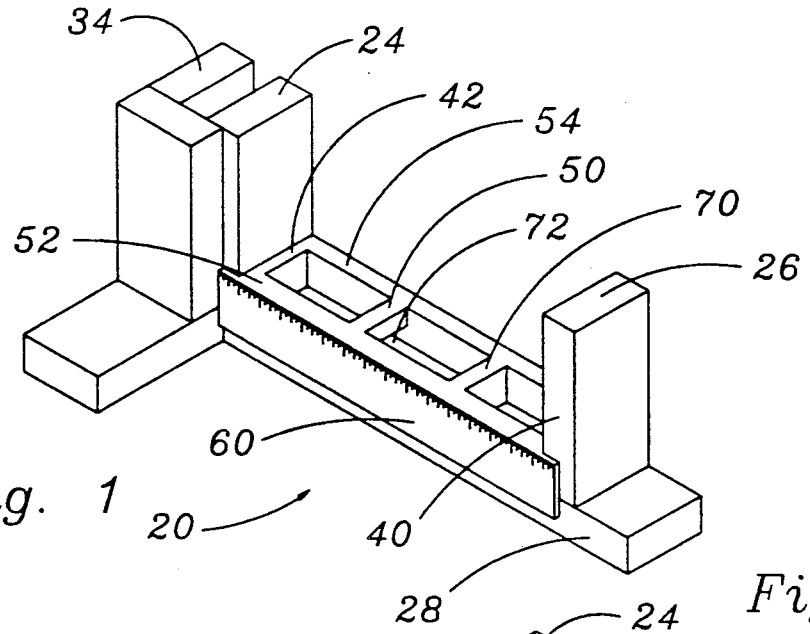
Fig. 1
Fig. 2
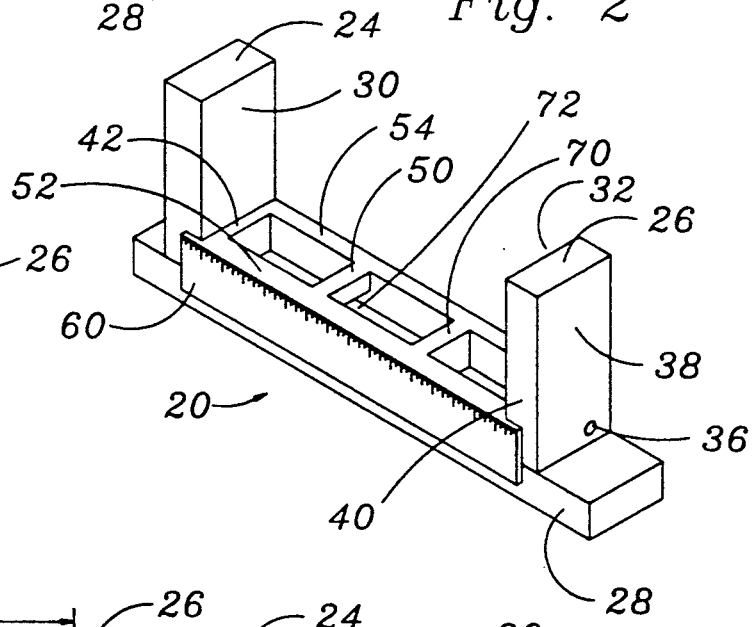
Fig. 9
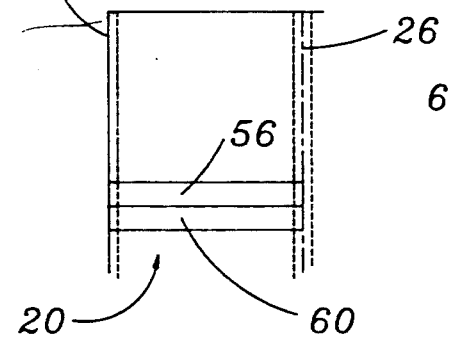
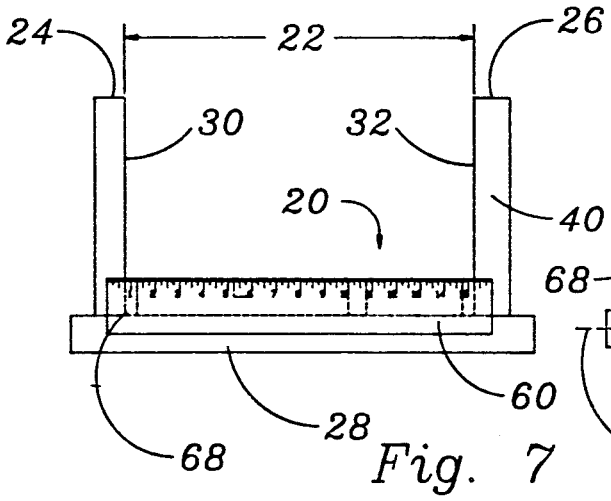
Fig. 7
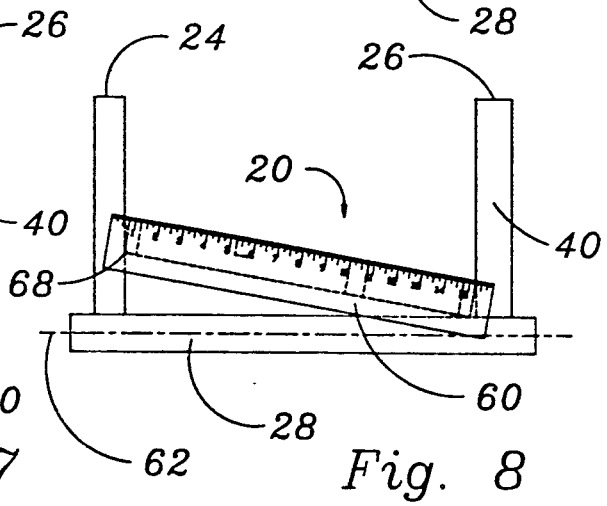
Fig. 8

Fig. 4
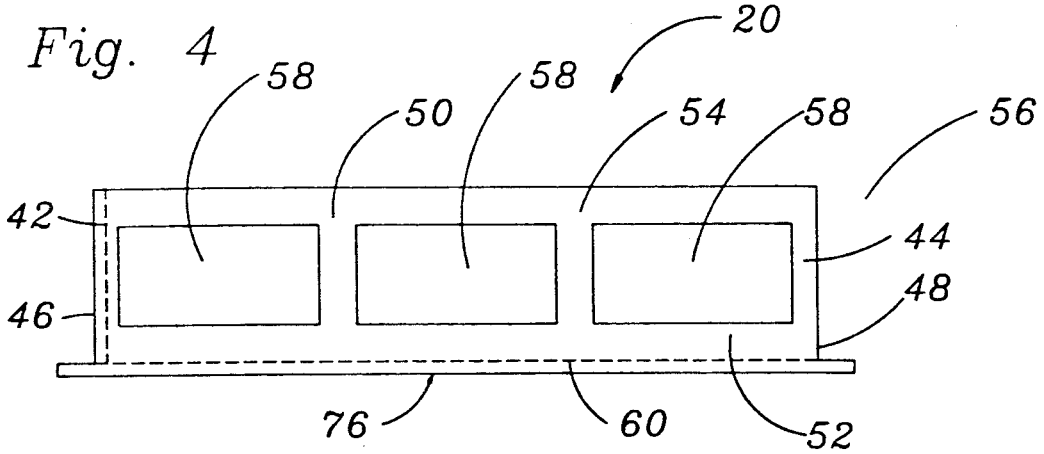
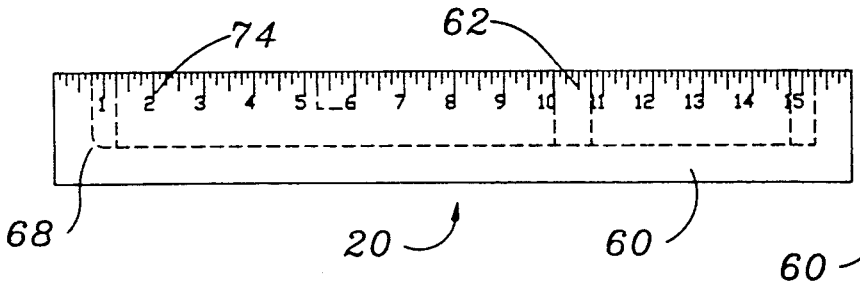
Fig. 3
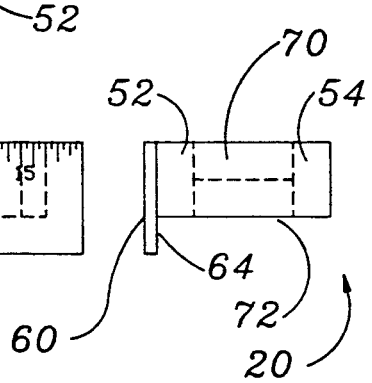
Fig. 5
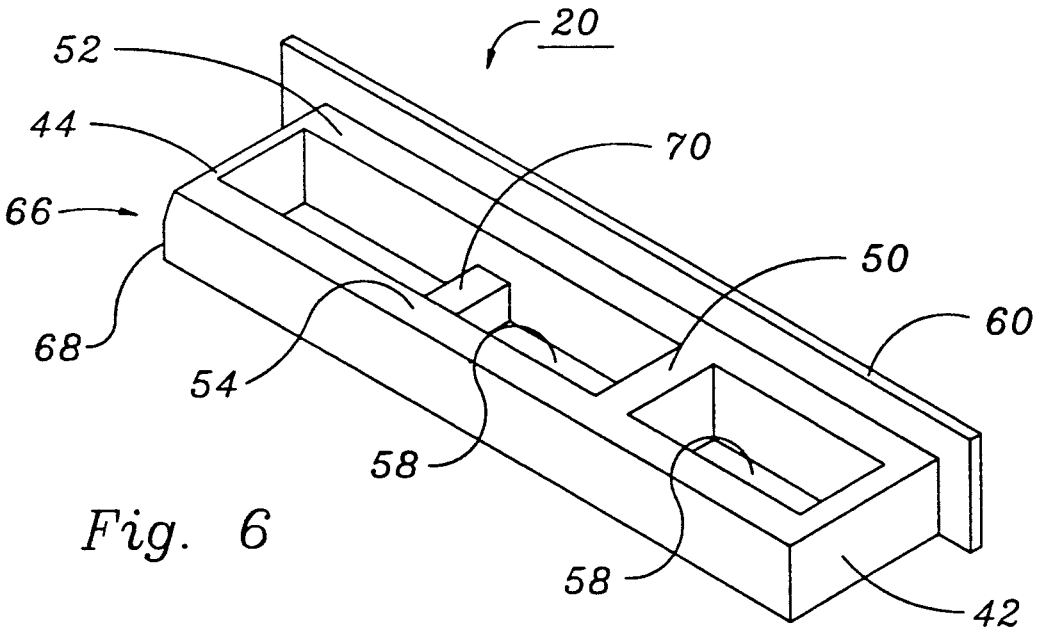
Fig. 6

STRUCTURAL MEMBER SPACING TOOL

BACKGROUND OF THE INVENTION

1. Technical Field

This invention relates to a carpentry tool and, more particularly, to a tool for spacing structural members such as joists, studs, rafters and the like, which also supports the structural member while it is fastened in place.

2. Description of the Prior Art

Various standards are known for spacing structural members in building construction. For example, walls are generally formed from a plurality of parallel studs, spaced 16 inches apart from centerline to centerline. The studs are fastened to a sole plate on the bottom and a header plate on top.

Standardized spacing for structural members provides for structural integrity as well as facilitating installation of dry wall, paneling and the like, generally provided as 4 foot by 8 foot sheets. More specifically, by utilizing uniform spacing between studs, the studs will be properly positioned to provide a fastening surface at the edges of such drywall sheets and the like. For the same reasons, the spacing between floor joists and roof rafters must also be maintained uniform to provide fastening surfaces for the edges of the 4 foot by 8 foot plywood and particle board sheets.

Various methods are known in the art for providing uniform spacing between structural members. For example, in wall construction, one method is to utilize a measuring tape and mark the sole plate and header plate at uniform intervals. More specifically, the sole plate and the header plate, generally 2 inch × 4 inch members, are turned on end (e.g., the 2 inch end) and marked every 16 inches along their length. The studs are then positioned along the markings and fastened in place. Although such a method is widely used, particularly by do-it-yourselfers, it has several disadvantages. First, such a method can result in inaccurate spacing. More specifically, the centerline of the studs must be aligned with the markings along the sole plate and header plate. Many times the centerline of the stud is not measured but rather, only approximated and aligned with the spacing mark. Moreover, the stud can move as it is being fastened in place. This can lead to inaccuracies which can accumulate and result in the lack of a fastening surface for an edge of a drywall sheet, for example. Secondly, such a method is cumbersome and time-consuming.

As a result, various tools are known in the art for spacing structural members. Such tools are disclosed in U.S. Pat. Nos. 1,066,694; 2,567,586, 4,499,666; and 4,607,438. However, such tools are generally only adapted to facilitate spacing and are not adapted to provide means for supporting the structural member while it is fastened in place and thus are cumbersome to use.

Various other tools are known for spacing structural members. However, such tools either have limited applications or are cumbersome to use. For example, U.S. Pat. No. 3,201,874 to Christy discloses a stud spacing guide which includes two spaced apart jaws for receiving adjacent studs and thereby positioning them. Each jaw is adapted to engage the stud on three sides. Accordingly, the use of such a tool is not practical for spacing studs adjacent a corner. Moreover, Christy teaches the use of two such spacing guides disposed intermediate the ends of the studs which results in an increased expense for such tools.

U.S. Pat. No. 4,843,726 to Ward discloses a tool which includes a plurality of parallel and spaced apart jaws secured together by way of interconnection members at acute angles forming a staircase like structure for positioning and temporary securement of a plurality of studs. Although such a tool is useful in accurately positioning studs, it is cumbersome to handle due to its irregular shape and length. It also requires temporary securement to the studs which, of course, must be removed, thus increasing the time to construct a wall, for example.

U.S. Pat. No. 4,625,415 to Diamontis discloses a tool for spacing studs which includes two spaced apart vertical support members connected together by an integrally formed connecting member. The vertical support members are formed with two U-shaped portions at right angles relative to each other. The U-shaped portions are adapted to engage adjacent studs as well as the sole plate on three sides. Since the vertical support members engage the adjacent studs and the sole plate on three sides, such a spacing guide would be inappropriate for stud walls adapted to be constructed flush against a masonry wall, for example.

SUMMARY OF THE INVENTION

It is an object of the present invention to solve the problems associated with the prior art.

It is another object of the present invention to provide a structural member spacing tool which provides support to prevent movement of the structural member while it is fastened in place.

It is yet another object of the present invention to provide a structural member spacing tool which can be utilized to space studs adjacent a corner.

It is yet a further object of the present invention to provide a structural member spacing tool for use in spacing structural members that are adapted to be flush against a masonry wall.

Briefly, the present invention relates to a structural member spacing tool that is adapted to be disposed between adjacent structural members for positioning the structural members a predetermined distance apart. The tool acts as a support to prevent movement of the structural members while they are fastened in place. More specifically, the tool is provided with parallel, spaced apart support surfaces which provide rigid support within a stud cavity defined between adjacent stud members. Since the tool is disposed within the stud cavity, it can be utilized in any stud cavity including the cavity adjacent a corner. This aspect also allows the tool to be used for walls that are adapted to be flush against a masonry wall.

DESCRIPTION OF THE DRAWING

These and other objects and advantages of the present invention will become readily apparent from the following description and accompanying drawing, wherein:

FIG. 1 is a perspective view of the structural member spacing tool in accordance with the present invention disposed between a corner stud and an adjacent stud;

FIG. 2 is similar to FIG. 1 and illustrates the tool in perspective disposed between intermediate studs;

FIG. 3 is a front view of the tool illustrated in FIG. 1;

FIG. 4 is a top view of the tool illustrated in FIG. 1;

FIG. 5 is a side view of the tool illustrated in FIG. 1;

FIG. 6 is a bottom rear perspective view of the tool illustrated in FIG. 1;

FIG. 7 is a front view of the tool in FIG. 1 illustrated between adjacent structural members in an operational position;

FIG. 8 is similar to FIG. 7 illustrating the tool partially removed; and

FIG. 9 is a front view of the tool in accordance with the present invention illustrating its use to locate hidden structural members.

DETAILED DESCRIPTION OF THE DRAWING

The tool in accordance with the present invention, generally identified with the reference numeral 20, is adapted to be used as a spacing guide for various types of structural members, such as studs, joists, rafters and the like. The following description and the accompanying drawing illustrate the use of the tool for spacing studs. However, it should be clear to those of ordinary skill in the art that the principles of the invention need not be so limited. Moreover, it should also be understood that the principles of the invention can be utilized for various standardized spacing requirements, for example, 12 inches, 16 inches, 24 inches or virtually any length.

The tool in accordance with the present invention is adapted to be disposed in a cavity 22 defined between adjacent structural members, such as structural members 24 and 26 to provide relatively precise spacing therebetween. For example, building walls may be constructed from structural members, such as 2 inch × 4 inch studs, vertically disposed in a spaced apart relationship. The studs 24 and 26 are normally attached on the bottom to a sole plate 28 and on the top to a top plate (not shown). The studs 24 and 26 are generally spaced apart a predetermined distance, for example, 16 inches, from centerline to centerline. Since the 2 inch × 4 inch studs are actually only 1½ inches wide, the distance between inwardly facing stud surfaces 30 and 32 within a particular cavity 22 is 14½ inches. Accordingly, the tool 20 is adapted to fit within a cavity 22 to provide a rigid support between the inwardly facing stud surfaces 30 and 32 to prevent movement of the structural member 26 while it is being fastened in place. More specifically, a building wall is constructed by fastening a stud 34 on one end of the sole plate 28. A second stud 24 is disposed usually a 2 inch × 4 inch width from the stud 34 to form an inside corner to provide a fastening surface, for example, for drywall, paneling or the like. The spacing between the studs 34 and 24 may be provided by another 2 inch × 4 inch stud or by 2 inch × 4 inch blocks (not shown). Once the stud 24 is fastened to both the sole plate 28 and the header plate, the tool 20 is disposed on the sole plate 28, flush against the stud surface 30. The inwardly facing stud surface 32 of another stud 26 is placed firmly against the tool 20. Since the tool provides a rigid support between the studs 24 and 26, the stud 26 can be fastened in place by driving a fastener 36 through an outwardly facing surface 38 of the stud 26 at an angle into the sole plate 28. As will be discussed in more detail below, the tool 20 can be rather easily removed from the stud cavity 22 so that additional fasteners 36 can be driven at angles into the surfaces 32 and a front surface 40 of the stud 26 if desired. The tool 20 can then be disposed adjacent the header plate and the process repeated. Additional studs are fastened to the sole plate 28 and the header plate in a similar manner.

The tool 20 in accordance with the present invention includes a pair of parallel, spaced apart rigid support members 42 and 44 defining outwardly facing support surfaces 46 and 48. The support surfaces 46 and 48 are adapted to engage inwardly facing stud surfaces 30 and 32. One or more additional support members 50 may be disposed in parallel and intermediate the support members 42 and 44 to provide for additional rigidity of the tool 20. The support members 42, 44 and 50 are interconnected by front and rear connecting members and 54, respectively, disposed generally at right angles thereto forming a rectangular structure 56 having one or more cavities 58.

The rectangular structure 56 is formed with a predetermined length equal to provide a predetermined spacing between adjacent structural members 24 and 26. For 16 inch spacing, the length of the rectangular structure 56 or the distance between the outwardly facing support members 46 and 48 would be 14½ inches. Such a length will provide 16 inch spacing between centerlines of adjacent 2 inch × 4 inch studs 24 and 26. The width of the rectangular structure 56 is conveniently formed with a width equal to the width of the stud surfaces 30 and 32. For 2 inch × 4 inch stud members, this width would be 3½ inches to allow the rectangular structure 56 to be contained within the stud cavity 22 and relatively flush or recessed relative to the front and rear planes of the studs 24 and 26 defined, by the front surface 40 and the rear surface (not shown) of the stud 26.

A face plate 60 may be attached to the front connecting member 52. The rectangular dimension of the face plate 60 may be slightly greater than the surface area of the front connecting member 52. This feature allows the face plate 60 to locate the tool 20 relative to the stud surfaces 30 and 32 as well as provide means for determining the centerlines of the adjacent studs 24 and 26 and the sole plate 28. More specifically, the face plate 60 is formed with a length slightly longer than the length of the front connecting member 52. For 6 inch spacing, the length of the face plate 60 is provided as 16 inches while t he length of the front connecting member 42 is 14½ inches. The face plate 60 is centered relative to the front connecting member 52, as best shown in FIG. 3, such that it extends a predetermined distance, for example, ⅜ inch on each end. Since a standard stud is 1½ inches wide, the ends of the face plate 60 will identify the centerlines of the adjacent studs.

As best shown in FIG. 3, the width of the face plate 60 is also provided slightly larger than the width of the front connecting member 52. The extended width of the face plate 60 relative to the front connecting member 52 can also be used for marking a horizontal line 62 along the length of the sole plate 28 a predetermined distance from the floor or bottom of the sole plate 28.

As best shown in FIG. 5, the top of the face plate 60 is disposed flush with the top of the front connecting member 52 defining an extending portion 64 on the face plate 60. The length of the extending portion 64 can be varied to facilitate marking of the horizontal line 62 virtually any distance from the floor when the tool 20 is resting on the sole plate 28, for example, the centerline of the sole plate 28. The horizontal line 62 is often used to mark where the bottom edge of the drywall, for example, should be located. More specifically, drywall and the like is generally spaced a predetermined distance from the floor before being supported and fastened to the studs 24 and 26 as well and the sole plate 28.

In addition to locating the centerlines, for example, of the studs 24 and 26 and the sole plate 28, the extended length and/or extended width of the face plate 60 relative to the front connecting member 52 facilitates locating the tool 20 within a stud cavity 22 relative to the width (e.g., the 4 inch surface) of the sole plate 28. More specifically, in order for the tool 20 to provide rigid support during fastening, for example, a stud 26, it is necessary that substantially the entire width of the outwardly facing support surfaces 46 and 48 be substantially in engagement with the stud surfaces 30 and 32. The extended length and/or an extended width of the face plate 60 relative to the front connecting member 52 allows an interior surface of the face plate 60 to seat against the front surfaces of the studs 24 and 26 and the sole plate 28 when the tool is disposed on the sole plate 28, thereby locating the rectangular structure 56 relative to the stud surfaces 30 and 32. This provides for relatively quick and easy positioning of the tool 20.

In order to facilitate removal of the tool 20 from a stud cavity 22, one end 66 of the rectangular structure 56 is provided with beveled or rounded surfaces. These surfaces 68 permit-the end 66 of the tool to be rather easily lifted upwardly once the stud 26 is rigidly secured in place. A handle 70 is also provided to facilitate removal. As best shown in FIG. 5, the handle 70 is formed as a reduced width intermediate structural member. Thus, when the tool 20 is resting on a sole plate 28, a cavity 72 is defined beneath the handle 70 to allow an operator to get his hands around the handle 70 to facilitate removal as shown in FIGS. 7 and 8.

For convenience, graduations 74 may be provided on a front surface 76 of the face plate 60. These graduations 74 may be in inches or any other convenient form, such as in metric units. It should be understood, however, that the face plate 60 as well as the graduations 74 are not required for spacing and supporting studs.

Another important aspect of the tool 20 is its ability to be used for locating hidden supports on a finished wall. More specifically, in certain remodeling applications, it is sometimes desirable to cover a finished wall of drywall, for example, with paneling. In such an application the studs 24 and 26 are beneath the drywall and thus hidden from sight. In order to locate the hidden studs for purposes of fastening the paneling thereto, the front surface 76 of the face plate 60 can be placed flush against the wall surface. An end of the face plate 60 is disposed at the corner of the wall as shown in FIG. 9. The opposite end of the face plate will then provide the location of the centerline of the adjacent stud. This location can be marked and the process repeated to locate all of the studs on the wall.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the U.S. is:

1. A structural member spacing tool comprising:

means for spacing adjacent structural members a predetermined distance apart defining a cavity therebetween;

means for supporting one of said structural members in order to fasten it in place; wherein said supporting means and said spacing means are totally disposed within said cavity between said adjacent structural members; and means for locating a predetermined position along a structural member disposed at substantially right angles to said adjacent structural members.

2. A structural member spacing tool as recited in claim 1, further including means for positioning said spacing means and said supporting means relative to said cavity.

3. A structural member spacing tool as recited in claim 1, further including means for locating the centerlines of one or the other of said adjacent structural members.

4. A structural member spacing tool as recited in claim 1, further including means for locating the centerlines of both of said adjacent structural members.

5. A structural member spacing tool as recited in claim 1, wherein said predetermined position is the centerline.

6. A structural member spacing tool as recited in claim 1, further including means for locating hidden support members.

7. A structural member spacing tool as recited in claim 1, further including means for facilitating removal of said tool from said cavity.

8. A structural member spacing tool comprising:

means for spacing adjacent structural members a predetermined distance apart defining a cavity therebetween;

means for supporting one of said structural members in order to fasten it in place; wherein said supporting means and said spacing means are disposed within said cavity; and wherein said spacing means defines opposing ends and said facilitating means includes a curved surface formed on one of said ends wherein said curved surface is adapted to be disposed adjacent one of said studs.

9. A structural member spacing tool as recited in claim 8, wherein said facilitating means further includes a handle.

10. A structural member spacing tool for providing a predetermined spacing between inwardly facing surfaces of adjacent structural members having a plurality of surfaces, each member formed with a predetermined width comprising:

a pair of generally parallel supports, spaced apart a predetermined distance and adapted to be disposed between said inwardly facing surfaces of said adjacent structural members;

front and rear connecting members rigidly connected to said pair of supports forming a rectangular structure, said rectangular structure having a width substantially equal to or less than the width of a predetermined one of said plurality of surfaces and a length substantially equal to the distance between said inwardly facing surfaces at said predetermined spacing; and means for locating the centerlines of one or the other of said adjacent structural members.

11. A structural member spacing tool as recited in claim 10, wherein said predetermined spacing is 16 inches.

12. A structural member spacing tool as recited in claim 10, wherein said predetermined spacing is 24 inches.

13. A structural member spacing tool for providing a predetermined spacing between inwardly facing surfaces of adjacent structural members having a plurality of surfaces, each member formed with a predetermined width comprising:

a pair of generally parallel supports, spaced apart a predetermined distance; and front and rear connecting members rigidly connected to said pair of supports forming a rectangular structure, said rectangular structure having a width substantially equal to or less than the width of a predetermined one of said plurality of surfaces and a length substantially equal to the distance between said inwardly facing surfaces at said predetermined spacing, wherein said one surface of said rectangular structure is at least partially curved to facilitate removal of said tool.

14. A structural member spacing tool for providing a predetermined spacing between inwardly facing surfaces of adjacent structural members having a plurality of surfaces, each member formed with a predetermined width comprising;

a pair of generally parallel supports, spaced apart a predetermined distance;

front and rear connecting members rigidly connected to said pair of supports forming a rectangular structure, said rectangular structure having a width substantially equal to or less than the width of a predetermined one of said plurality of surfaces and a length substantially equal to the distance between said inwardly facing surfaces at said predetermined spacing; and a face plate having a length relatively longer than the length of said rectangular structure and rigidly connected to said rectangular structure to be centered therewith defining extending portions for locating said rectangular structure relative to said structural member.

15. A structural member spacing tool as recited in claim 14, wherein said face plate is further formed with a width substantially larger than the width of said rectangular structure.

16. A structural member spacing tool as recited in claim 14, wherein said face plate is provided with graduations.

17. A structural member spacing tool as recited in claim 13, further including one or more intermediate supports for increasing the rigidity of said rectangular structure.

18. A structural member as recited in claim 13, further including a handle for facilitating removal of the tool.

* * * * *

UNITED STATES PATENT AND TRADEMARK OFFICE

CERTIFICATE OF CORRECTION

PATENT NO. :5,129,153

DATED :July 14, 1992

INVENTOR(S) :JOSEPH F. BURNS, SR.

It is certified that error appears in the above-identified patent and that said Letters Patent is hereby corrected as shown below:

Column 4, line 12, after "members" insert --52--.
Column 4, line 42, delete "6" and substitute --16--.
Column 4, line 44, delete "t he" and substitute --the--.

Column 5, line 24, after "surfaces" insert --68--.

Signed and Sealed this

Thirty-first Day of August, 1993

Bruce Lehman

*Attest:*

BRUCE LEHMAN

*Attesting Officer*

*Commissioner of Patents and Trademarks*